United States Patent [19]

Huhta-Koivisto

[11] Patent Number: 4,733,637

[45] Date of Patent: Mar. 29, 1988

[54] PURE STEAM GENERATOR

[75] Inventor: Esko Huhta-Koivisto, Espoo, Finland

[73] Assignee: Santasalo-Sohlberg Oy, Finland

[21] Appl. No.: 10,917

[22] Filed: Feb. 5, 1987

[30] Foreign Application Priority Data

Feb. 5, 1986 [FI] Finland ..... 860524

[51] Int. Cl.[4] ..... F23M 7/04; F22B 1/06

[52] U.S. Cl. ..... 122/488; 122/489; 122/492; 122/32

[58] Field of Search ..... 122/488, 489, 492

[56] References Cited

U.S. PATENT DOCUMENTS

| | | | |
|---|---|---|---|
| 1,114,874 | 10/1914 | Fox | 122/488 |
| 2,743,709 | 5/1956 | Armacost | 122/488 |
| 2,763,245 | 9/1956 | Place | 122/488 |
| 4,261,298 | 4/1981 | McDonald et al. | 122/488 |
| 4,385,908 | 5/1983 | Carmichael | 122/489 |
| 4,522,156 | 6/1985 | Chaix | 122/488 |
| 4,622,103 | 11/1986 | Shirley-Elgood et al. | 122/489 |

*Primary Examiner*—Henry C. Yuen

*Attorney, Agent, or Firm*—Steinberg & Raskin

[57] ABSTRACT

A pure steam generator having a feed line for conducting feed water thereinto, a heating steam input for conducting heating steam thereinto, and a heat exchange apparatus therein for providing heat exchange between the heating steam and the feed water. A pure steam output is also provided, with a separation space being located in a lower portion of the pure steam generator, along with a centrifugal separator through which the pure steam flows from the separation space to the pure steam output.

The pure steam output communicates through a circulation line with the pure steam generator for circulating pure steam from the pure steam output to the pure steam generator. The circulation line is preferably arranged to feed a mixing space, in which the feed water and the circulating pure steam are mixed.

8 Claims, 1 Drawing Figure

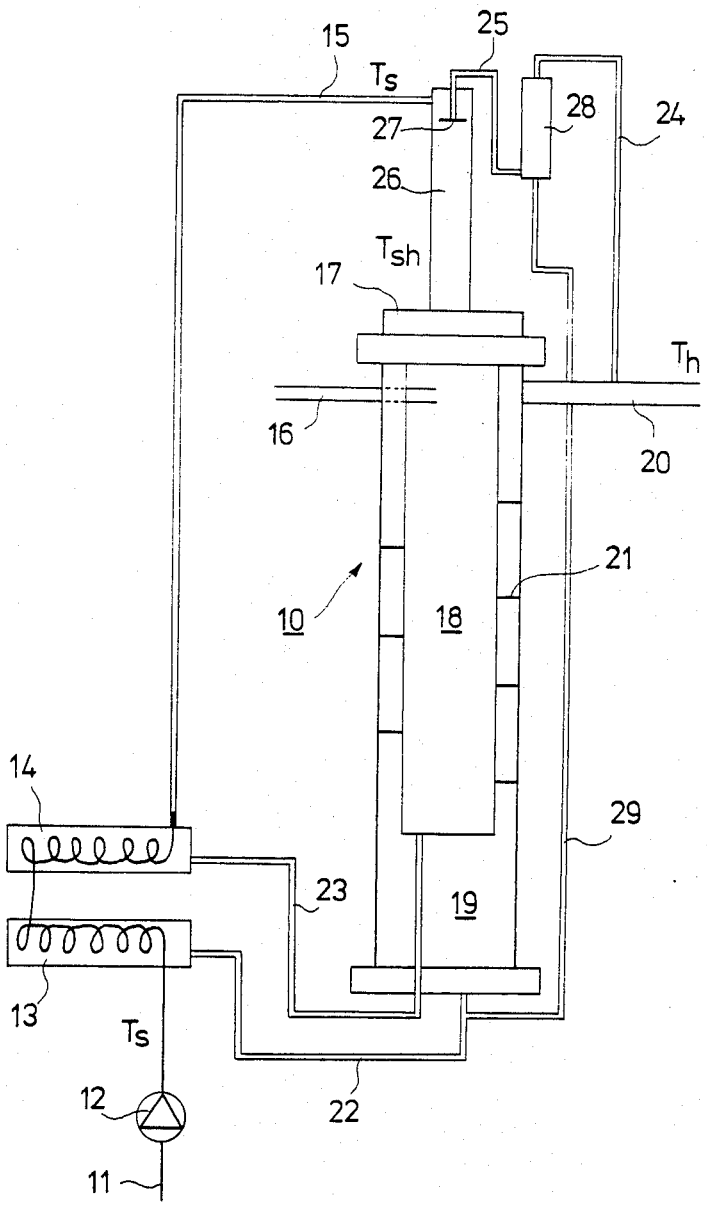
15
25
Ts
28
24
27
26
Tsh
17
Th
16
20
21
10
18
14
29
23
19
13
Ts
12
22
11

PURE STEAM GENERATOR

BACKGROUND OF THE INVENTION

The present invention concerns a pure steam generator comprising a feed line for conducting feed water into the pure steam generator, a heating steam input, heat exchange apparatus for accomplishing heat exchange between the heating steam and the feed water, a pure steam output, a separation space located in a lower part of the pure steam generator, and a centrifugal separator which is arranged so that the pure steam flows therethrough from the separation space to the pure steam output.

Exceedingly strict quality requirements are imposed on pure or sterile steam to be used in steam sterilization in the pharmaceutical industry. The pure or sterilizing steam must also be absolutely free from pyrogenic impurities. It should be noted that if the steam used for sterilizing is not absolutely free from pyrogens, then drug packaging treated with such steam may be damaged, with result that such drug packaging will be unfit for use.

The pure steam generator is, in fact, a distilling apparatus having no condenser, with the pure steam so generated in fact being the same as uncondensed distillate, used, for example, in injection solutions.

In pure steam generators, purity requirements have been solved in a design of the prior art, by providing feed water that is pyrogen-free. In this case, the steam which is produced is clearly free from pyrogens. However, using this kind of high-quality feed water involves considerable expense, and therefore this design of the prior art is not the best possible solution to the problem with respect to economies and conservation.

In view of this, it is general practice to use impure feed water in pure steam generators known in the art. The feed water is conducted with the aid of a feed pump along a feed line, generally through a waste water heat exchanger and a condensate heat exchanger for the condensate of the heating steam, and then through a feed water input connector to a distribution space in the upper part of the pure steam generator, where the feed water flows in heat exchange with a heat exchange tubing system downwardly; from the lower part of the pure steam generator, the pure steam so generated is conducted through a centrifugal separator to the pure steam output. The condensate of the heating steam is conducted to the heating steam condensate heat exchanger, while the waste water from the feed water passing through the heat exchange tubing system, is conducted to the waste water heat exchanger, to preheat the feed water.

A drawback of the pure steam generator of the prior art described above, is that when pure steam is not drawn from the pure steam generator for consumption, there is a risk that when pure steam is again drawn for consumption, the first few liters thereof will contain impurities, in particular pyrogenic impurities.

SUMMARY OF THE INVENTION

Accordingly, it is an object of the present invention to provide improvement over the pure steam generators previously known in the art.

It is a more detailed object of the present invention to provide a pure steam generator in which the pure steam generated is reliably pure and sterile, with the purity thereof being maintained, even if the pure steam so generated is not continuously drawn off for consumption.

These and other objects are attained by the present invention which is directed to a pure steam generator principally characterized by the pure steam output communicating through a circulation line with the pure steam generator itself, for circulating pure steam from the pure steam output to the pure steam generator.

In the pure steam generator of the present invention, a pure steam circulation line passes from the pure steam output to a mixing space in which the feed water and the circulated steam are mixed, with the mixture then flowing through a distribution space back to the pure steam generator. It is thus understood that the energy consumed by the pure steam circulation is restored to the process in accordance with the design and method of the present invention.

When a valve at the pure steam output is opened, the pressure p falls in the circulation line, whereby the feed water could flow through the circulation line to the pure steam output, and the impurities contained in the feed water may then pass from the pure steam output to the point of consumption, contaminating the pure steam. Therefore, to protect the system of the present invention, separator means are provided in the pure steam circulation line, for eliminating the effect of an abrupt differential pressure $\Delta p$ on the pure steam output when the valve provided therein is opened.

BRIEF DESCRIPTION OF THE DRAWING

The present invention will be described in further detail, referring to principles and design illustrated in the accompanying drawing, to which, however, the present invention is not intended to be exclusively confined. In the drawing, FIG. 1 illustrates a schematic, elevational view of a preferred embodiment of the pure steam generator in accordance with the present invention.

DESCRIPTION OF THE PREFERRED EMBODIMENT

Referring to FIG. 1, the pure steam generator is generally indicated by reference numeral 10, with the raw water feed line being indicated reference numeral 11. A feed pump 12 feeds the raw water along the feed line 11, through a waste water heat exchanger 13, and through a heating steam condensate heat exchanger 14, to a feed water input connector 15, from which the feed water flows through a distribution space 17 at an upper end of the pure steam generator 10, thereinto. A heating steam input into the pure steam generator 10, is indicated by reference numeral 16. Inside the pure steam generator 10, a heat exchange tube system 18 is located, whereby the feed water, while flowing downwardly, is in heat exchange with the heat exchange tube system, and at least partially vaporizes, to form pure steam. This implies that there is both pure steam and non-evaporated feed water in a separation space 19 at a lower part of the pure steam generator 10, as illustrated.

From the separation space 19, the pure steam is conducted through a centrifugal separator 21 to the a pure steam output 20. The centrifugal separator 21 separates pure steam from contaminating feed water drops and maybe a helical duct, described, e.g. in U.S. Pat. No. 3,875,017. A waste water line 22 leads from the separation space 19 to the waste water or overflow heat exchanger 13. The condensate of the heating steam which condenses within the the heat exchange tubing system 18, is conducted along a line 23 to the heating steam condensate heat exchanger 14.

When pure steam is periodically drawn from the steam generator 10, the steam is not moving during the idling intervals, and the centrifugal separator 21 is inoperative, whereby impurities may appear in the steam production during the standstill. Such impurities will be entrained by the steam at the start of the next period of consumption, and passed to the point of consumption through the pure steam output 20. Later, as conditions become stable, this detriment will naturally no longer occur.

In order to overcome this drawback, in the steam generator 10 of the present invention, pure steam is conveyed from the pure steam output 20 along a pure steam circulation line 24 which leads through a connector 25 to a mixing space 26 provided at an upper portion of the pure steam generator 10, as illustrated in accordance with the present invention. The circulated steam is advantageously introduced into the mixing space 26 through dispersing means 27 which is, e.g. a nozzle structure or a straining plate, to discharge the steam into the mixing space in the form of fine mist. In the mixing space 26, the pure steam condenses into the feed water and raises the temperature of the feed water $T_s$ close to the boiling point in accordance with the existing conditions.

In the pure steam generator of the present invention, the feed water temperature $T_s$ in the feed line 11 is, as a rule, 5°–10° C. The feed water temperature $T_s$ at the input connector 15 (after the pre-heating 13 and 14) is on order of about 80° C. The temperature $T_h$ of the pure steam at the pure steam output 20 is approximately 140°–150° C. Owing to design operation of the present invention, the temperature $T_{sh}$ of the circulating pure steam, and that of the feed water is nearly the same, i.e., about 140°–150° C. Thus, in the design and operation of the present invention, the energy consumed in the circulating pure steam is returned to the process and steam generator 10.

When a valve 20 (not illustrated) at the pure steam output 20 is opened, then the pressure p in the circulation line 20, 24, 25, and 26 drops, whereby the feed water could pass through the circulation line 26, 25, 24 and 20 to the pure steam output 20, so that the impurities contained the feed water might then pass from the pure steam output 20 to the point of consumption. To serve a protection of the system in accordance with the present invention, separator means 28 is provided in the pure steam circulation line 24, for the purpose of eliminating the effect of the abrupt differential pressure $\Delta p$ at the pure steam output 20, when the valve at this point is opened.

The feed water containing impurities may then flow only as far as the separator means 28, with the feed water further flowing from the separator means 28 through a by-pass line 29 to the waste water line 22. The separator means 28 thus operates as a kind of safety device which guarantees that no impurities can gain access into the pure steam output 20 at any stage of the process.

The separator means 28 may be constituted by a large space, i.e. an expansion space. Thus, if in some operational circumstances the feed water is able to flow along circulation line 25 to the separator means 28, the feed water will still not able to rise upwardly in the large space 28 and flow further along circulation line 24 to the outlet of pure steam 20. Thus, in this case, the circulating water remains in the expansion space 28, and flows downwardly along line 29.

The preceding description of the present invention is merely exemplary, and is not intended to limit the scope thereof in any way. It is clear that numerous modifications thereof are feasible within the scope of the present invention.

What is claimed is:

1. In a pure steam generator, comprising a feed line coupled to said pure steam generator for conducting feed water thereinto, a heating steam input coupled to said pure steam generator for conducting heating steam thereinto, heat exchange apparatus situated within the pure steam generator for effecting heat exchange between the heating steam and the feed water introduced thereinto, whereby pure steam is generated, a separation space situated in a lower part of said pure steam generator, through which the generated, pure steam flows, a centrifugal separator coupled with said separation space through which the pure steam flows from said separation space, a pure steam output connected with said centrifugal separator, the improvement comprising the combination of a circulation line coupled with said pure steam output and with said pure steam generator, for circulating pure steam from said pure steam output to said pure steam generator, means provided in said circulation line for separating out any feed water flowing therethrough, whereby flow of feed water into said pure steam output is prevented when a pressure drops occurs in said output, a bypass line coupled with said feed water separating means for conducting the separated feed water away from said feed water separating means, and a waste water line coupled with said separation space for conducting waste water out from said generator, with said bypass line coupled with said waste water line.

2. The combination of claim 1, additionally comprising a mixing space coupled with said generator, said feed line, and said circulation line, for mixing of the feed water and the circulating pure steam.

3. The combination of claim 1, additionally comprising means for dispersing the circulated pure steam as the same flows into said mixing space.

4. The combination of claim 2, additionally comprising a distributing space situated at an upper end of the pure steam generator and coupled with said mixing space for distributing the mixed flow of feed water and circulating pure steam into the generator.

5. The combination of claim 4, wherein said heat exchange apparatus comprise a plurality of tubes, at least one tube coupled with said mixing space and with said separating space, and at least one other tube coupled with said heating steam input, whereby the feed water, while flowing downwardly, is in heat exchange with the heating steam and at least partially vaporizes to form the pure steam.

6. The combination of claim 1, additionally comprising a condensate line coupled with said generator for conducting condensate of the heating steam out from said generator, a waste water heat exchanger situated along both said feed water line and said waste water line, whereby waste water heat is tranferred to said feed water, and a condensate heat exchanger situated along both said feed water line and said condensate line, whereby condensate heat is transferred to said feed water, and the feed water is thereby pre-heated.

7. In a pure steam generator, comprising a feed line coupled to said pure steam generator for conducting feed water thereinto, a heating steam input coupled to said pure steam generator for conducting heating steam thereinto, heat exchange apparatus situated within the pure steam generator for effecting heat exchange between the heating steam and the feed water introduced thereinto, whereby pure steam is generated, a separation space situated in a lower part of said pure steam generator, through which the generated, pure steam flows, a centrifugal separator coupled with said separation space through which the pure steam flows from said separation space, a pure steam output connected with said centrigual separator, the improvement comprising the combination of a circulation line coupled with said pure steam output and with said pure steam generator, for circulating pure steam from said pure steam output to said pure steam generator, a mixing space coupled with said generator, said feed line, and said said circulation line, for mixing of the feed water and the circulating pure steam, a distributing space situated at an upper end of the pure steam generator and coupled with said mixing space for distributing the mixed flow of feed water and circulating pure steam into the generator, wherein said heat exchange apparatus comprise a plurality of tubes, at least one tube coupled with said mixing space and with said separating space, and at least one other tube coupled with said heating steam input, whereby the feed water, while flowing downwardly, is in heat exchange with the heating steam and at least partially vaporizes to form the pure steam, and a condensate line coupled with said at least one other heat exchange tube, whereby condensate of the heating steam is removed from the pure steam generator.

8. The combination of claim 7, additionally comprising means provided in said circulation line for separating out any feed water flowing therethrough, whereby flow of feed water into said pure steam output is prevented when a pressure drop occurs in said output.

* * * * *